US005667417A

United States Patent [19]

Stevenson

[11] Patent Number: 5,667,417

[45] Date of Patent: Sep. 16, 1997

[54] METHOD FOR MANUFACTURING AN ELECTROLUMINESCENT LAMP

[76] Inventor: William C. Stevenson, 5916 Las Virgines Rd., Suite 687, Calabasas, Calif. 91302

[21] Appl. No.: 393,084

[22] Filed: Feb. 22, 1995

[51] Int. Cl.[6] ..... H05B 33/10

[52] U.S. Cl. ..... 445/24; 445/58; 427/66

[58] Field of Search ..... 445/24, 58; 427/66

[56] References Cited

U.S. PATENT DOCUMENTS

| | | | |
|---|---|---|---|
| 3,315,111 | 4/1967 | Jaffe et al. | 427/66 |
| 4,853,079 | 8/1989 | Simopoulos et al. | 427/66 |
| 5,116,270 | 5/1992 | Aizawa et al. | 445/24 |
| 5,469,019 | 11/1995 | Mori | 445/24 |
| 5,491,379 | 2/1996 | Daigle et al. | 427/66 |

OTHER PUBLICATIONS

W. Stevenson Bacon, "Now They're Printing Transistors On Paper?" Nov. 1968 (Class: 430/319).

*Primary Examiner*—David Pirlot
*Assistant Examiner*—Jeffrey T. Knapp
*Attorney, Agent, or Firm*—Francis G. Rushford; Randall L. Owen

[57] ABSTRACT

A method for manufacturing low-cost electroluminescent (EL) lamps is disclosed. The method of the present invention includes the first step of die cutting, embossing or chemically etching a metal foil to form one or more rear capacitive electrodes. Next, the capacitive electrodes are bonded to a paper core stock which is coupled to a precisely positioned indexing system. In the third step, a layer of EL phosphor ink is applied to the capacitive electrodes to precisely form the areas of illumination. In step four, a layer of conductive ITO ink is applied to cover the layer of EL phosphor ink. Next, in step five a transparent polyester film or ultraviolet activated dielectric coating is applied to the entire surface of the lamp. Finally, in step six electrical terminations are provided to the rear capacitive electrode and the layer of conductive ITO ink.

18 Claims, 6 Drawing Sheets

METHOD FOR MANUFACTURING AN ELECTROLUMINESCENT LAMP

BACKGROUND OF THE INVENTION

1. Field of the Invention

The present invention relates to electroluminescent lamps, and more particularly to a method for manufacturing water proof electroluminescent lamps which are suitable for many low-cost consumer applications.

2. Description of the Prior Art

Conventional electroluminescent (EL) lamp manufacturing techniques may be divided into two basic processes. The first is a screen printing process in which the lamp is constructed layer by layer. More particularly, the lamp is constructed using costly electroluminescent inks, clear conductive indium tin oxide (ITO) transparent films, conductive inks compounded with a high volume of metallic silver and a water repellent electrical insulating coating containing an ultraviolet light-activated polymer.

The screen printing process allows intricate graphics effects to be created using relatively simple manufacturing processes. However, screen printed EL lamps having high luminance or superior electrical characteristics tend to be costly to manufacture. Typical manufacturing costs in high volume applications range from eight to thirteen cents per square inch, while minimal quality and performance standards result in savings of less than two cents per square inch.

The second process is the continuous lamination method. In this process, a first film which supports a foil is passed below a metering roller or blade which applies an insulating layer of ink. A second transparent film that has been sputter coated with clear conductive ITO is similarly passed below a roller or blade, which applies a layer of phosphor ink. In order to achieve a uniform light output and electrical characteristics, the thickness of the insulating and phosphor layers must be precisely controlled, along with the phosphor grain dispersion in the phosphor layer. Thus, the continuous lamination method requires very tight control over ink rheology.

Once the ink layers have been dried and inspected for defective areas, the first and second films are laminated together to form a lamp core. The film lamination requires heat and/or pressure which must be tightly controlled so that the light and electrical characteristics of the finished lamp are not affected. Additionally, since the phosphor layer is sensitive to water contamination, the finished lamp is cut into the desired size and shape, electrically terminated and encapsulated within a water impervious lamination film (such as Allied Signal's "ACLAR" CTFE).

The continuous lamination method produces foil EL lamps, which are high performance, high priced lamps typically unsuitable for graphics or other price-sensitive applications. Foil EL lamps are also thicker and mechanically less flexible than screen printed EL lamps. The typical cost of foil sensitive lamps is greater than thirty cents per square inch, and the lamps are typically used in military, aircraft and high-end industrial applications.

Accordingly, there is a need for a method for manufacturing low-cost EL lamps which can be applied to both graphics and price-sensitive consumer applications.

SUMMARY OF THE INVENTION

The present invention is directed to a method for manufacturing EL lamps which incorporates some of the processes which have been used in manufacturing flexible printed circuit boards.

In an exemplary embodiment of the invention, the method of the present invention includes the following steps. In the first step, a metal foil is bonded to an insulating paper or plastic core stock and is die cut or chemically etched to form one or more rear capacitive electrodes. Next, the insulating paper or plastic core stock is coupled to a precisely positioned indexing system. In the preferred embodiment, the indexing system may include sprocket holes along one or more edges of the insulating paper or plastic core stock.

In the third step, a layer of hygrophobically compounded high dielectric strength EL phosphor ink is applied to the rear capacitive electrodes to precisely form the areas of illumination. The EL phosphor ink is allowed to bleed past the edges of the rear capacitive electrodes, thereby providing insulation between the front and rear capacitive electrodes. In step four, a layer of transparent or translucent conductive indium tin oxide (ITO) or tin oxide ink is applied to cover the layer of EL phosphor ink, forming a front capacitive electrode. The ITO ink is allowed to bleed beyond the EL phosphor ink in order to make contact with a metal foil power conductor.

Next, in step five a transparent polyester film or ultraviolet activated dielectric coating is applied to the entire surface of the lamp. Finally, in step six metal foil power conductors are provided to the front and rear capacitive electrodes.

A first embodiment of an EL lamp manufactured by the method of the present invention comprises a capacitive electrode bonded to a paper core stock. A layer of EL phosphor ink is printed on the capacitive electrode to precisely define the areas of illumination. A layer of conductive ITO ink printed on the EL phosphor layer and is covered by an insulating layer consisting of a transparent polyester film.

In a second embodiment of an EL lamp manufactured by the method of the present invention, the capacitive electrodes and phosphor ink and ITO layers are bonded to both surfaces of the paper core stock. The embodiment provides a low-cost EL lamp which emits light from both surfaces.

The method of the present invention provides the ability to manufacture EL lamps at a cost of less than five cents per square inch. Additionally, these low-cost EL lamps can be manufactured using existing or readily obtainable equipment.

Further features and advantages of the present invention will be appreciated by a review of the following detailed description of the preferred embodiments taken in conjunction with the following drawings.

BRIEF DESCRIPTION OF THE DRAWINGS

The present invention may be best understood by referring to the following detailed description of the preferred embodiments and the accompanying drawings, wherein like numerals denote like elements and in which.

DETAILED DESCRIPTION OF THE PREFERRED EMBODIMENTS

Figure 1A:
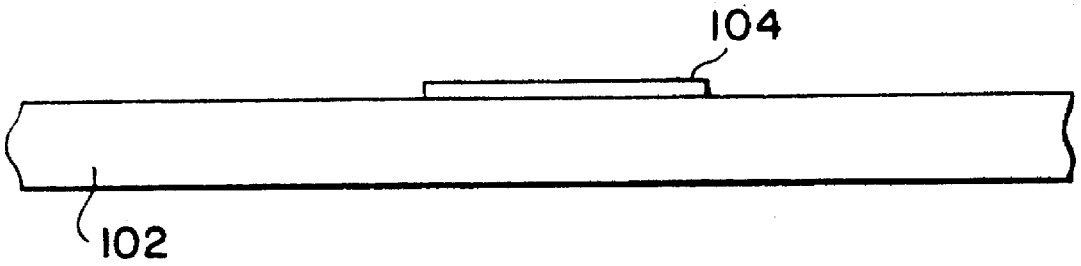
FIGS. 1(*a*)–(*d*) are a sequence of diagrams illustrating a method for manufacturing a low-cost EL lamp in accordance with the present invention.
Figure 1B:
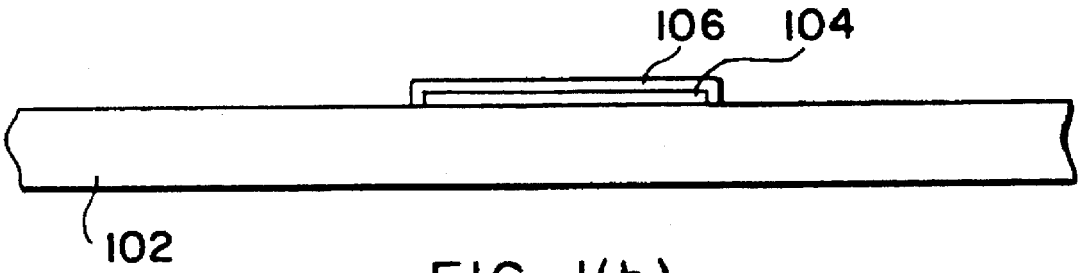
Figure 1C:
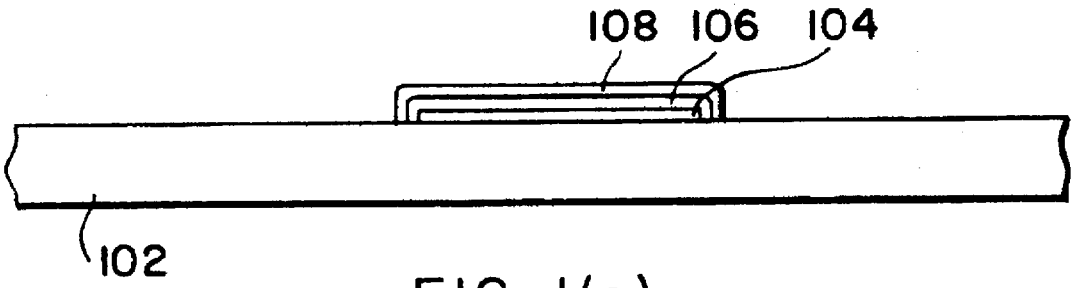
Figure 1D:
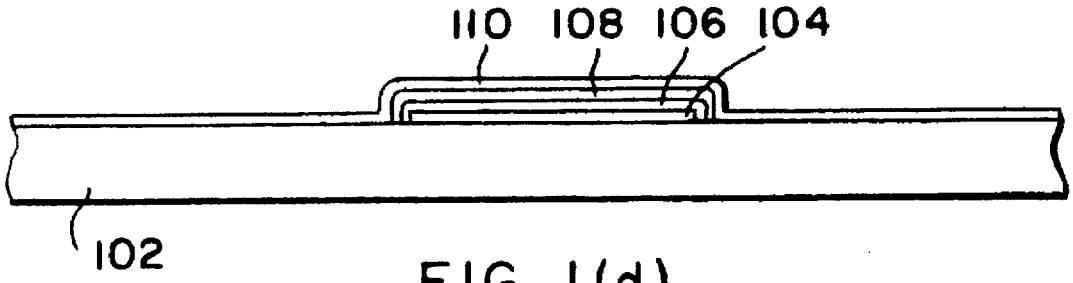

The following exemplary discussion focuses on the manufacturing of a low-cost electroluminescent (EL) lamp. The (EL) lamp produced by the method of the present invention is suitable for a variety of graphics and low-cost consumer applications.

Referring to FIGS. 1(*a*)–(*d*), a sequence of diagrams illustrating a preferred method for manufacturing a low-cost EL lamp in accordance with the present invention is shown. In the first step of the method, a 0.002 inch thick metal foil is die cut or chemically etched to form one or more rear capacitive electrodes 104 which are bonded to a paper or plastic core stock 102. Alternatively, the metal foil can also be embossed onto the paper or plastic core stock from a separate metal foil supply. The typical thickness of paper or plastic core stock 102 is approximately 0.01 inch. The die cutting or chemical etching may be done using any of a number of conventional techniques. Additionally, paper or plastic core stock 102 may be coupled to a conventional precision indexing system (not shown), which may use sprocket holes which are provided along one or more edges of paper or plastic core stock 102.

In the next step, a layer of EL phosphor ink 106 is applied to rear capacitive electrodes 104 to precisely form the areas of illumination. EL phosphor ink layer 106 is allowed to bleed past the edges of rear capacitive electrodes 104 by approximately 0.02 inch, thereby insulating rear capacitive electrodes 104. A layer of conductive ITO ink 108 is then applied to cover layer of EL phosphor ink 106, with ITO ink layer 108 also being allowed to bleed past the edges of EL phosphor ink layer 106 by approximately 0.02 inch. The use of the precision indexing system allows the distribution of the layers of EL phosphor ink 106 and conductive ITO ink to be specifically limited to those areas of capacitive electrodes 104 which are to be illuminated. For example, complex graphical patterns such as circles within circles, text or individually addressable lamp elements (pixels) may be created.

Continuing with FIGS. 1(*a*)–(*d*), a transparent or translucent polyester film 110 is then applied to the entire surface of the lamp. Polyester film 110 is typically 0.0005 inch thick, which provides adequate protection against contamination and possible electrical shock.

In an alternative first step, the metal foil may be replaced by a conductive plastic film which has been die cut to form capacitive electrodes 104. In addition, EL phosphor ink 106 may be replaced by a plastic film imbued with EL phosphors. Similarly, conductive ITO ink 108 may be replaced by an ITO-coated transparent or translucent polyester film. Further, transparent or translucent polyester film 110 may be replaced by an ultraviolet activated dielectric coating.

Paper or plastic core stock 102 may be replaced with any of a variety of flexible, non-conducting materials such as thin plastic or fiberglass. Further, paper or plastic core stock 102 may be completely replaced by a metal foil which has been coated on one or both surfaces by layers of EL phosphor ink, a conductive ITO coating and a transparent or translucent insulating coating or lamination.

Figure 2:
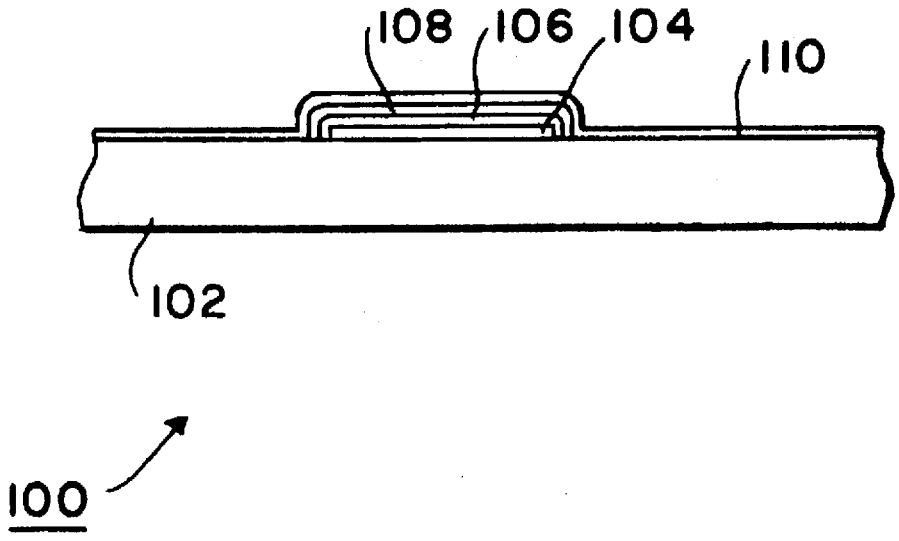
FIG. 2 is a cross-sectional view of a first exemplary EL lamp 100 constructed in accordance with the method of FIGS. 1(*a*)–(*d*)

Referring now to FIG. 2, a cross-sectional view of a first exemplary EL lamp 100 constructed in accordance with the above method is shown. Lamp 100 includes paper or plastic core stock 102, rear capacitive electrode 104, EL phosphor layer 106, front conductive ITO layer 108 and clear electrical insulator 110. Note that layers 106 and 108 both overlap rear capacitive electrode 104 in order to provide electrical isolation between layers 106 and 108, while allowing layer 108 to make contact with a metal foil power conductor. Capacitive electrode 104 is permanently bonded to paper core stock 102 using a non-conducting bonding compound. EL phosphor layer 106 provides a precise definition of the area of illumination, while avoiding any waste of the expensive phosphor ink.

Figure 3:
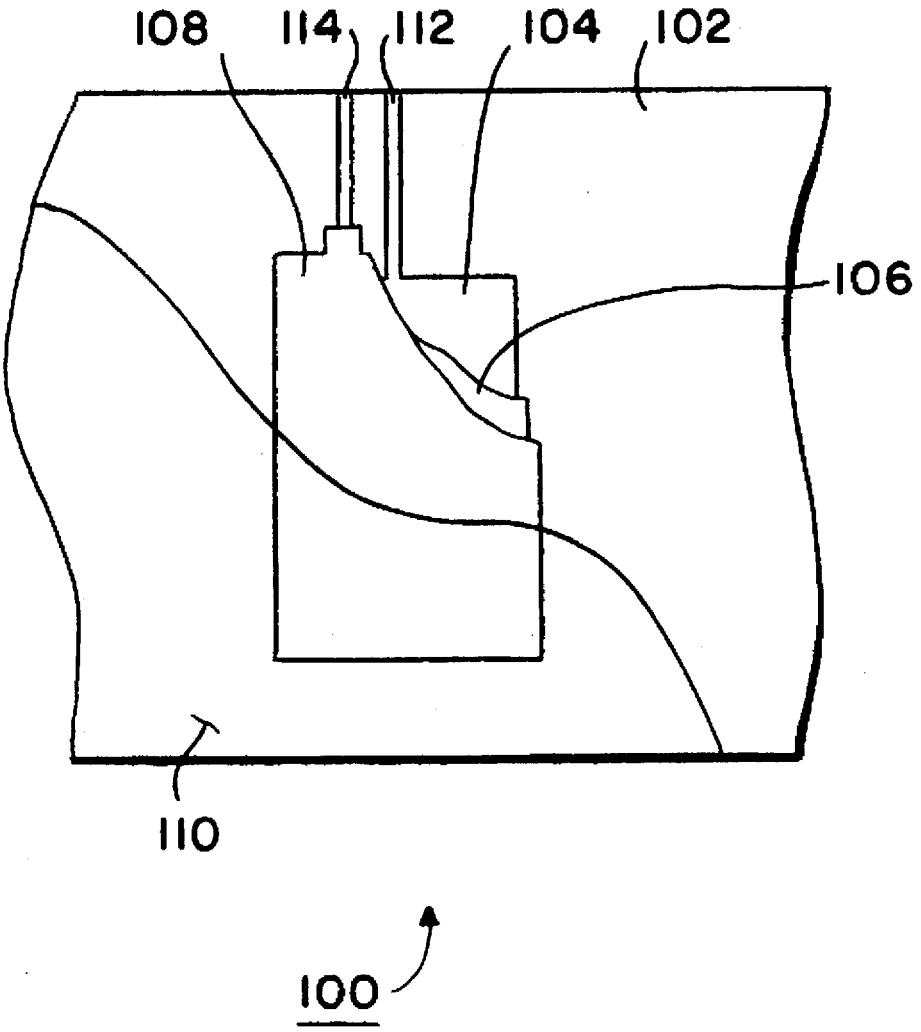
FIG. 3 is a top view of EL lamp 100 of FIG. 2.

FIG. 3 provides a top view of exemplary EL lamp 100. As shown in FIG. 3, capacitive electrode 104 and EL phosphor ink layer 106 define a rectangular area of illumination. However, the specific shape of the area of illumination is not limited to simple rectangles, circles or polygons. Any pattern with which EL phosphor ink may be printed onto capacitive electrode 104 may define the area of illumination.

Continuing with FIG. 3, metal foil conductors 112 and 114 are used to provide electrical power to rear capacitive electrode 104 and front conductive ITO layer 108. When an appropriate alternating current (AC) power source is connected to conductors 112 and 114, current flows through EL phosphor ink 106, thus providing illumination. Note also that the mechanical structure of EL lamp 100 provides a lighting source which is light-weight and flexible.

Figure 4:
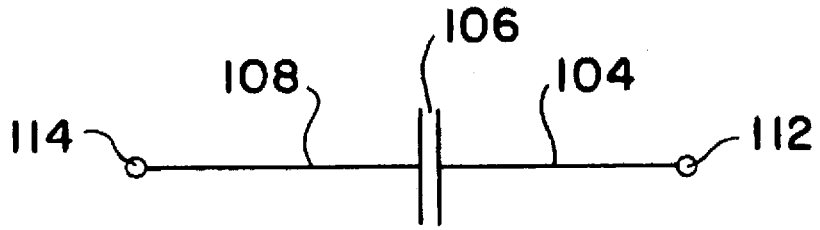
FIG. 4 is a schematic diagram of an equivalent circuit of EL lamp 100.

Referring now to FIG. 4, a schematic diagram of an equivalent electrical circuit of EL lamp 100 is shown. EL lamp 100 functions as a capacitor with capacitive electrode 104 as one plate and conductive ITO layer as the other plate. EL phosphor ink layer 106 form the dielectric of the capacitor. When an AC power source is connected to terminals 112 and 114, current passes through phosphor ink layer 106 resulting in illumination.

Figure 5:
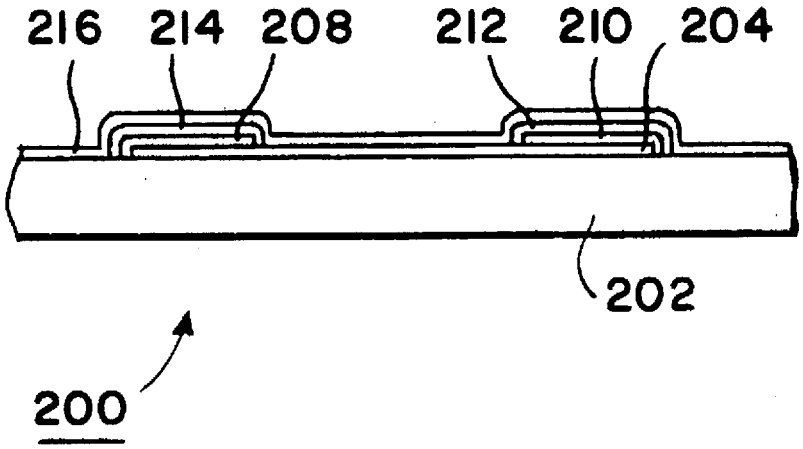
FIG. 5 is a cross-sectional view of a second exemplary EL lamp 200 constructed in accordance with the method of FIGS. 1(*a*)–(*d*)

Referring now to FIG. 5, a cross-sectional view of a second exemplary EL lamp 200 constructed in accordance with the above method is shown. Lamp 200 includes paper or plastic core stock 202, rear capacitive electrode 204, EL phosphor layers 208 and 210, front conductive ITO layers 212 and 214 and clear electrical insulator 216. Rear capacitive electrode 204 is permanently bonded to paper or plastic core stock 202 using a non-conducting bonding compound. EL phosphor layers 208 and 210 provide a precise definition of the area of illumination, while avoiding any waste of the expensive phosphor ink.

Figure 6:
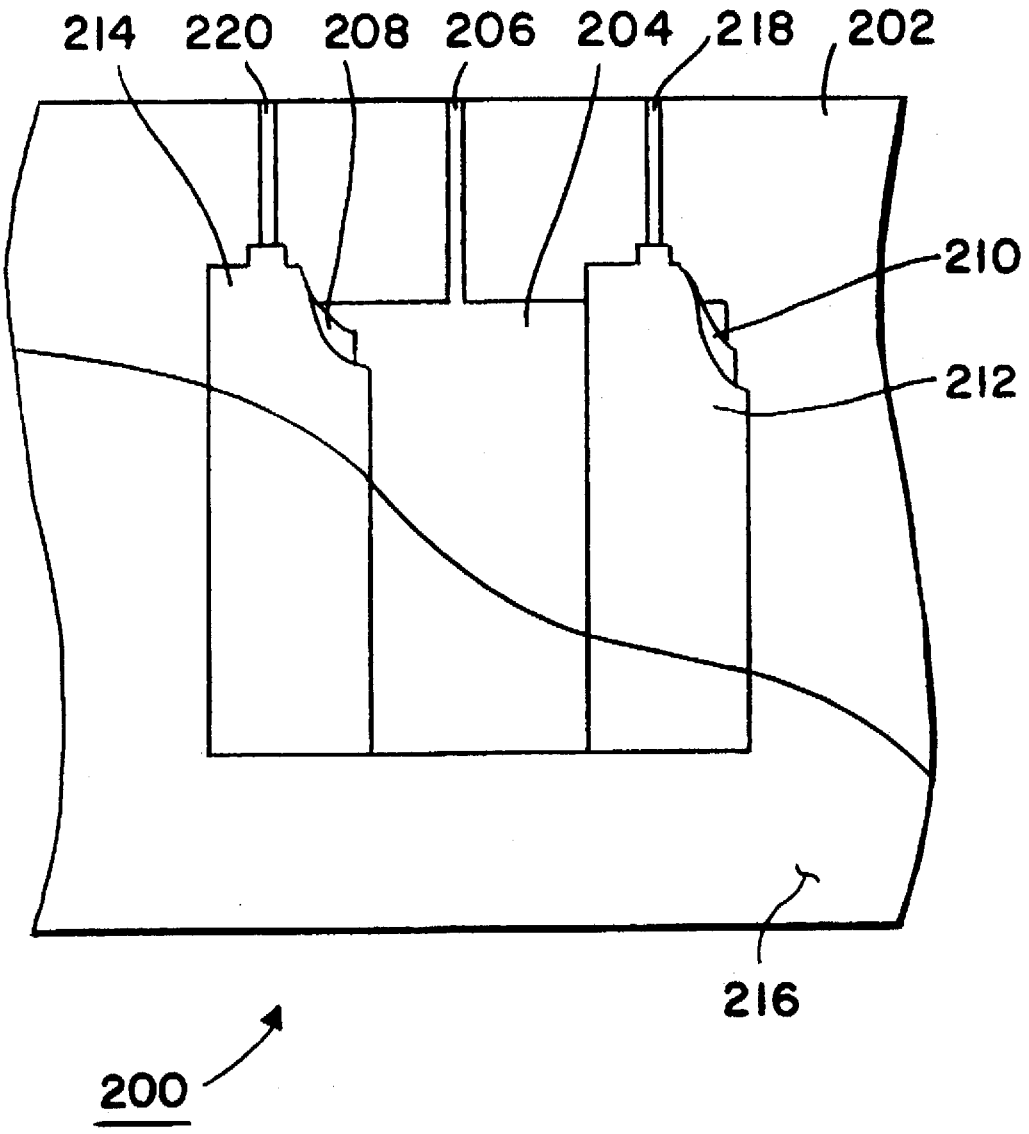
FIG. 6 is a top view of EL lamp 200 of FIG. 5.

FIG. 6 provides a top view of exemplary EL lamp 200. As shown in FIG. 6, rear capacitive electrode 204 and EL phosphor ink layers 208 and 210 define a pair of rectangular areas of illumination. However, the specific shape of the areas of illumination is not limited to simple rectangles, circles or polygons. Any patterns with which EL phosphor ink may be printed onto capacitive electrode 204 may define the area of illumination.

Continuing with FIG. 6, metal foil conductors 206, 218 and 220 are used to provide electrical power to capacitive electrode 204 and conductive ITO layers 212 and 214. When an appropriate AC power source is connected to conductors 206 and 218, current flows through EL phosphor ink layer 210 to ITO layer 212, thus providing illumination of the corresponding rectangular area. Similarly, when an AC power source is connected to conductors 206 and 220, current flows through EL phosphor ink layer 208 to ITO layer 214, thus providing illumination of the corresponding rectangular area. Finally, when an AC power source is connected to conductors 218 and 220, current flows through EL phosphor ink layers 208 and 210 using rear capacitive electrode 204 as a capacitive current path, thus providing illumination of both rectangular areas. Therefore, either or both rectangular areas may be illuminated by providing power to the appropriate electrical terminals.

Note also that the mechanical structure of EL lamp 100 provides a lighting source which is light-weight and flexible.

Figure 7:
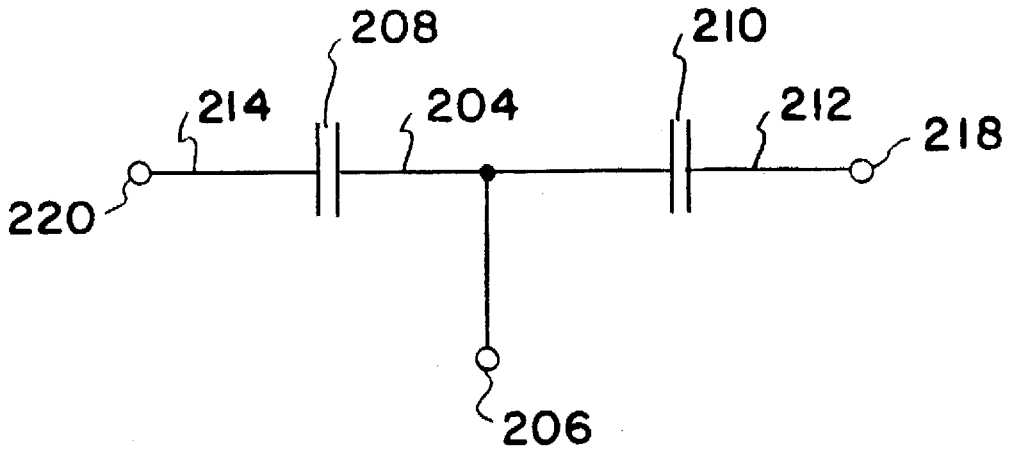
FIG. 7 is a schematic diagram of an equivalent circuit of EL lamp 200.

Referring now to FIG. 7, a schematic diagram of an equivalent electrical circuit of EL lamp 200 is shown. EL lamp 200 functions as a pair of capacitors connected in series, with capacitive electrode 204 as the center plate and conductive ITO layers 212 and 214 as the outer plates. EL phosphor ink layers 208 and 210 form the dielectric regions of the capacitors. When an AC power source is connected to terminals 206 and 220, current passes through phosphor ink layer 208 resulting in illumination. Similarly, when an AC power source is connected to terminals 206 and 218, current passes through phosphor ink layer 210 resulting in illumination. Finally, when an AC power source is connected to terminals 218 and 220, current passes through phosphor ink layers 208 and 210 resulting in illumination.

Thus, the method of present invention provides a low-cost EL lamp which provides substantial illumination. Additionally, the EL lamp produced by the method of the present invention consume low power and generate little or no heat. Further, the EL lamp produced by the method of the present invention has an essentially unlimited useful life, making regular replacement unnecessary.

The foregoing description includes what are at present considered to be preferred embodiments of the invention. However, it will be readily apparent to those skilled in the art that various changes and modifications may be made to the embodiments without departing from the spirit and scope of the invention. Accordingly, it is intended that such changes and modifications fall within the spirit and scope of the invention, and that the invention be limited only by the following claims.

What is claimed is:

1. A method for manufacturing an electroluminescent lamp, said method comprising the steps of:

forming a capacitive electrode from an indium tin oxide plated conductive plastic film;

applying a layer of electroluminescent phosphor ink to said capacitive electrode, said electroluminescent phosphor ink for precisely defining an area of illumination;

applying a layer of conductive indium tin oxide ink to said layer of electroluminescent phosphor ink; and applying an insulating coating to a surface of said conductive indium tin oxide ink.

2. A method for manufacturing an electroluminescent lamp, said method comprising the steps of:

forming a capacitive electrode from a metal foil by embossing said metal foil onto an insulating paper core stock;

applying a layer of electroluminescent phosphor ink to said capacitive electrode, said electroluminescent phosphor ink for precisely defining an area of illumination;

applying a layer of conductive indium tin oxide ink to said layer of electroluminescent phosphor ink; and applying an insulating coating to a surface of said conductive indium tin oxide ink.

3. The method of claim 2 wherein said metal foil is die cut to form said capacitive electrode.

4. The method of claim 2 wherein said metal foil is chemically etched to form said capacitive electrode.

5. A method for manufacturing an electroluminescent lamp, said method comprising the steps of:

bonding a capacitive electrode to a paper core stock;

applying a layer of electroluminescent phosphor ink to said capacitive electrode, said electroluminescent phosphor ink for precisely defining an area of illumination;

applying a layer of conductive indium tin oxide ink to said layer of electroluminescent phosphor ink;

applying an insulating coating to an entire surface of said electroluminescent lamp; and attaching electrical terminations to said capacitive electrode and said layer of conductive indium tin oxide ink.

6. The method of claim 5 further comprising the step of forming said capacitive electrode from an indium tin oxide plated conductive plastic film.

7. The method of claim 5 wherein said indexing system further comprises a plurality of sprocket holes along one or more edges of said paper core stock.

8. The method of claim 5 wherein said step of applying said insulating coating further comprises the step of applying a transparent polyester film.

9. The method of claim 5 wherein said step of applying said insulating coating further comprises the step of applying a translucent polyester film.

10. The method of claim 5 wherein said step of applying said insulating coating further comprises the step of applying an ultraviolet activated dielectric coating.

11. The method of claim 5 wherein said step of applying a layer of electroluminescent ink further comprises the step of applying a dielectric plastic film imbued with electroluminescent phosphors.

12. The method of claim 5 further comprising the step of forming said capacitive electrode from a metal-plated conductive plastic film.

13. The method of claim 12 wherein said metal-plated conductive plastic film is die cut to form said capacitive electrode.

14. The method of claim 12 wherein said metal-plated conductive plastic film is chemically etched to form said capacitive electrode.

15. The method of claim 1 further comprising the step of forming said capacitive electrode from a metal foil.

16. The method of claim 15 wherein said metal foil is die cut to form said capacitive electrode.

17. The method of claim 15 wherein said metal foil is chemically etched to form said capacitive electrode.

18. The method of claim 15 wherein said metal foil is embossed onto said paper core stock.

* * * * *